United States Patent [19]

Morishita et al.

[11] Patent Number: 4,563,329

[45] Date of Patent: Jan. 7, 1986

[54] POWDER ALLOY SHEET FOR FORMING A WEAR RESISTANT LAYER ON A WORKPIECE

[75] Inventors: Tuyoshi Morishita; Sigemi Ohsaki; Yashuhumi Kawado, all of Hiroshima, Japan

[73] Assignee: Mazda Motor Corporation, Hiroshima, Japan

[21] Appl. No.: 547,102

[22] Filed: Oct. 31, 1983

[30] Foreign Application Priority Data

Nov. 1, 1982 [JP] Japan ..... 57-193125

[51] Int. Cl.[4] ..... B22F 5/00

[52] U.S. Cl. ..... 419/9; 156/196; 156/327; 419/36; 419/37; 428/461; 75/236; 75/238; 75/240; 75/241

[58] Field of Search ..... 419/9, 26, 28, 29, 36, 419/37; 428/461; 56/329; 156/196; 75/230, 236, 238, 240, 241

[56] References Cited

U.S. PATENT DOCUMENTS 4,386,959 6/1983 Frehn ..... 419/8

FOREIGN PATENT DOCUMENTS 51-83834 7/1976 Japan .
55-21802 6/1980 Japan .
58-73706 5/1983 Japan ..... 419/9
58-153706 9/1983 Japan ..... 419/9
900988 1/1982 U.S.S.R. ..... 419/9

*Primary Examiner*—Allan M. Lieberman
*Attorney, Agent, or Firm*—Fleit, Jacobson, Cohn & Price

[57] ABSTRACT

A powder alloy sheet including powders of wear-resistant eutectic alloy in a quantity of 85 to 97% in volume, and acrylic resin binder in a quantity of 15 to 3% in volume.

There is also disclosed a method for forming a wear-resistant layer on a workpiece comprising steps of providing a powder alloy sheet comprised on 85 to 97 vol. % of powders of wear-resistant eutectic alloy and 15 to 3 vol. % of acrylic resin binder, bonding the sheet on a workpiece surface, heating the workpiece under a non-oxidizing atmosphere to a semi-liquid phase sintering temperature to sinter the alloy powder.

14 Claims, 13 Drawing Figures

(X 200)

(X 200)

(X 200)

(X 100)

(X 100)

(X 100)

POWDER ALLOY SHEET FOR FORMING A WEAR RESISTANT LAYER ON A WORKPIECE

The present invention relates to powder alloy sheets comprised of alloy powders bonded by synthetic resin binders.

Hithertofore, this type of alloy powder sheets have been utilized for providing wear-resistant alloy layers on workpieces. For example, in Japanese Patent Application No. 50-9398 filed on Jan. 21, 1975 and disclosed for public inspection on July 22, 1976 under the disclosure number of 51-83834, there is proposed to prepare an powder alloy sheet comprised of powders of self-fluxing alloy and a thermoplastic resin binder and put the powder alloy sheet on a metallic workpiece using a solvent such as toluene as an adhesive. The workpiece with the powder alloy sheet adhered thereto is then heated under the atmosphere so that the resin binder is dissipated under heat and an alloy layer is formed on the workpiece. In the proposed process, the powder alloy sheet is adhered to the workpiece by the solvent when the temperature of the workpiece is low and, as the workpiece is heated, the resin binder starts to function as the adhesive to hold the powder alloy sheet on the workpiece under the temperature of 200° to 300° C. It should however be noted that, as the temperature of the workpiece further increases, the resin binder is dissipated and the adhesive function is lost. Further, since the alloy is of self-fluxing type, the alloy powders are molten and fluidized during the heating process so that the sheet cannot maintain its shape throughout the process. Therefore, these type of sheets have disadvantages in that they cannot be applied to sloped or curved surfaces, and/or downwardly directed surfaces.

In Japanese Patent Publication No. 55-21802 published on June 12, 1980, there is disclosed a process of manufacturing a tape of sintered alloy by providing a thin tape comprised of powders of wear resistant alloy such as WC type, NiTi type or TiC type alloy bonded by a synthetic resin binder and sintering the tape under pressure. The sintered tape is then attached to workpiece by means of screws or the like. It should however be noted that the proposed process requires many manufacturing steps. Besides, it requires screws or similar fasteners for securing the sintered tape to the workpiece.

It is therefore an object of the present invention to provide a powder alloy sheet which shows a satisfactory bonding power to a workpiece between a room temperature and a high sintering temperature.

Another object of the present invention is to provide a powder alloy sheet having a satisfactory bonding power under a high temperature close to the sintering temperature.

A further object of the present invention is to provide a powder alloy sheet which can readily be applied to and sintered on a slanted or curved surface to provide a wear-resistant layer thereon.

Still further object of the present invention is to provide a method for forming a wear-resistant layer on a workpiece surface by sintering a powder alloy sheet on the workpiece surface.

Accordng to the present invention, the above and other objects can be accomplished by a powder alloy sheet including powders of wear-resistant eutectic alloy in a quantity of 85 to 97% in volume, and acrylic resin binder in a quantity of 15 to 3% in volume. In forming the sheet, the acrylic resin is solved in a solvent and mixed with the powders of alloy to form a mixture which is rolled to a sheet configuration.

According to a further aspect of the present invention, there is provided a method for forming a wear-resistant layer on a workpiece comprising steps of providing a powder alloy sheet comprised of 85 to 97 vol.% of powders of wear-resistant eutectic alloy and 15 to 3 vol.% of acrylic resin binder, bonding the sheet on a workpiece surface, heating the workpiece under a non-oxidizing atmosphere to a semi-liquid phase sintering temperature to sinter the alloy powders.

It has been found that the acrylic resin used in the present invention as the binder for bonding the eutectic alloy together shows adhesive property without being carbonized and dissolution of the binder starts at a temperature of approximately 250° C. As the temperature increases beyond this value, the resin is carbonized but dissipated without producing bubbles or blows, and above 400° C. the resin looses the adhesive property. However, surprisingly, the mixture of the acrylic resin with the eutectic alloy powders does not show any peeling off from the workpiece surface even above 600 C. Moreover, such mixture does not produce any bubbles or blows in having the resin dissipated. The inventors have tested various types of resins including various types of thermo-setting resins, thermoplastic resins and two-component type curable resins and found that only acrylic resin can satisfactorily used in the powder alloy sheet for forming a wear-resistant layer on a workpiece surface. More specifically, the acrylic resin meets the requirements as the binder in such powder alloy sheet in that it produces a flexible sheet under a room temperature, that it is adhesive under a room temperature, that it does not show an a rupt pyrolysis, that it does not produce a substantial amount of carbides as the result of pyrolysis, that it does not produce a noticeable amount of gas which may cause bubbles or other surface defects, and that it is not likely to be peeled off from the workpiece surface and can maintain a sheet configuration in the sintering process. As well known in the art, the acrylic resin is a polymer of an acrylic ester or a methylacrylic ester and any type of acrylic resin can be used in the present invention.

The invention will now be described with reference to the accompanying drawings, in which.

Figure 1:
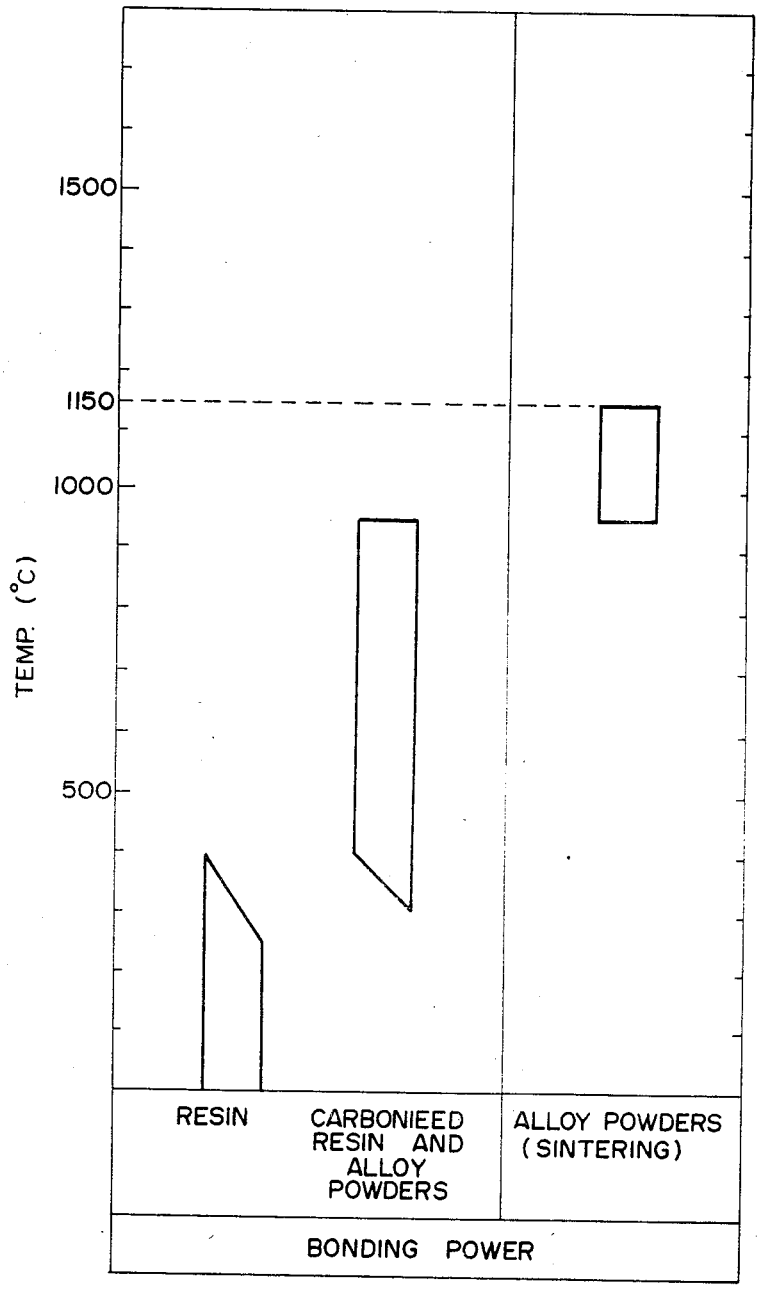
FIG. 1 is a diagram showing changes in bonding properties in accordance with a change in temperature.

When a powder alloy sheet comprised of powders of eutectic alloy and acrylic resin binder is bonded to a workpiece surface and heated to a sintering temperature, carbonization of the acrylic resin binder starts at a temperature of approximately 300° C. and is substantially completely carbonized at a temperature of approximately 800° C. During this course of heating, the bonding power of the resin is gradually decreased and the resin looses the bonding power at about 400° C. as shown in FIG. 1. In contrast, the bonding power of the carbon as produced through carbonization of the resin is gradually increased at the temperature above 300° C. and the carbon finally substitutes for the resin and functions as the binder between the alloy powders and the workpiece to maintain the alloy powders on the workpiece surface until the temperature is increased to a sintering zone.

Figure 2:
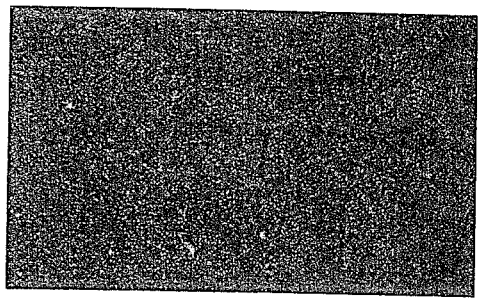
FIG. 2 is a carbon Kα-Xray photograph of the workpiece surface.
Figure 3:
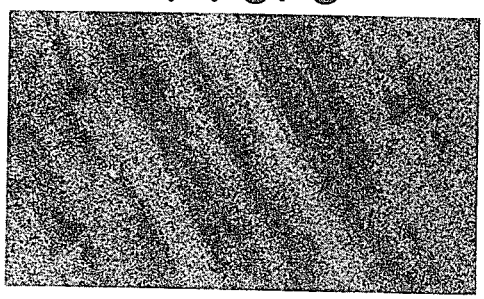
FIG. 3 is a carbon Kα-Xray photograph of the workpiece surface after the powder alloy sheet is peeled off from the workpiece.

In order to confirm the fact, tests have been carried out with samples in which powder alloy sheets in accordance with the present invention are bonded to surfaces of workpieces of an iron based material. The samples are then heated to 800° C. and the powder alloy sheets are mechanically peeled off the examine the interface between the powder alloy sheet and the workpiece surfaces. FIG. 3 shows a carbon Kα-Xray photograph of the workpiece surface which has been taken by injecting electron beams by means of X-ray microanalyzer to the workpiece surface after peeling off the powder alloy sheet from the workpiece to excite carbon particles and take pictures of Kα-Xrays radiated from the carbon particles. FIG. 2 shows a similar carbon Kα-Xray photograph taken from the workpiece surface before the alloy sheet is bonded. It will be noted in FIGS. 2 and 3 that the density of carbon particles are substantially increased by bonding the powder alloy sheet to and heating the workpiece to 800° C. to provide a satisfactory bonding power.

Figure 4:
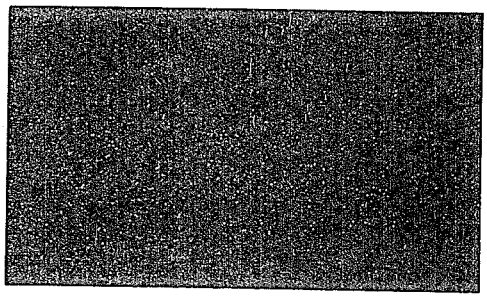
FIG. 4 is a phosphorous Kα-Xray photograph of the workpiece; surface after the alloy sheet is peeled off.

Referring to FIG. 4, there is shown a phosphorous Kα-Xray photograph of the workpiece. In FIG. 4, it will be noted that phosphorous particles are also distributed throughout the interface. It is understood that the phosphorous particles will contribute to the bonding power between the workpiece and the powder alloy sheet in a temperature range above approximately 800° C. It is therefore noted that, in a high temperature range, the bonding power can be maintained between the workpiece and the powder alloy sheet partly by the bonding power of the resin binder and partly by the bonding power of the alloy particles.

Referring now to the properties of the alloy powders, it is of course required that the alloy show a wear-resistant property when it is sintered on the workpiece. Besides, its sintering temperature should be as low as possible because there is a limit in temperature wherein the bonding power of the resin binder can be maintained. Thus, the present invention proposes to use powders of a wear-resistant eutectic alloy. It is preferred to use Fe—M—C type ternary eutectic alloy, wherein M is one or more of Mo, B and P. Particularly, a ternary eutectic alloy containing phosphorous is preferred because the phosphorous particles desirably diffuse to the workpiece. It is further preferred that the alloy has 10 to 50 vol.% of liquid phase at a temperature of about 1000° to 1150° C. and the alloy of liquid phase has a good affinity to the workpiece.

With the liquid phase smaller than 10 vol.% under the above temperature range, it becomes impossible to obtain a satisfactory bonding. However, if the liquid phase part exceeds 50 vol.%, the alloy shows an excessive fluidity so that it cannot maintain a sheet configuration.

Where a Fe—P—C type ternary eutectic alloy is used, phosphorous forms an eutectic with iron and carbon and contributes to wear-resistant property. Further, phosphorous is effective to decrease the melting point of the alloy. It is preferred that the phosphorous content be 0.5 to 2.5 weight %. With the phosphorous content less than 0.5%, it becomes impossible to maintain 10 vol.% of liquid phase under the aforementioned temperature range, however, if the phosphorous content is greater than 2.5%, there will be a network precipitation of phosphor containing eutectic and the tenacity of the alloy will adversely be affected.

Carbon content functions together with Fe and P to strengthen the base metal and form a hard layer. It also forms an eutectic with phosphorous to increase the density and the bonding power with the workpiece. It is preferred that the carbon content be 1.5 to 4.0 weight %. With the carbon content less than 1.5 weight %, there will be a decrease in the amount of eutectic having a low melting point and further the density and the bonding power will become insufficient. With the carbon content exceeding 4.0 weight %, an excessive amount of liquid phase will be produced and it will become difficult to maintain the sheet configuration. Further, there will be a network precipitation of carbides which cause a decrease in tenacity.

Where a Fe—Mo—C type ternary eutectic alloy is used, the Mo content forms a hard layer and contributes to increase the strength of the base metal. Further, it is combined with Fe and C to decrease the melting point. It is preferred that the Mo content be 2.5 to 10.5 weight %. With the Mo content less than 2.5%, the hard layer will become insufficient. Further, the liquid phase will also be insufficient so that the density and therefore the wear-resistant property will be decreased. Moreover, the decrease in the liquid phase will weaken the bonding power. With the Mo content greater than 10.5%, the liquid phase will become excessive so that the tenacity will be adversely affected.

Where a Fe—B—C type ternary eutectic alloy is used, the B content functions to form a hard metal with the Fe and C contents and to decrease the melting point. It is preferred that the B content be 0.5 to 3.0 weight %. With the B content less than 0.5%, the amount of ternary eutectic will become insufficient so that the wear-resistant and anti-seizure properties will become unsatisfactory. With the B content exceeding 3.0%, the alloy will become too fragile.

Further additives may be used to improve the strength and the wear-resistant property of the ternary eutectic alloy. For the purpose, Cr, V and/or W will effectively be used. These additives function to strengthen the base metal. Particularly, the tenacity of the metal is increased. Further, the additives serve to form a hard metal by being combined with C. The use of the additives in excess of 10 weight % is not recommended from an economical viewpoint since the effectiveness of the additives will be saturated.

Further, Si may be added to improve fluidity of molten alloy when the alloy powders are being prepared. It also improves affinity to the workpiece. However, if the Si content exceeds 5.0 weight %, there will be a decrease in hardness so that the wear-resistant property will be adversely affected. Ni may be added to increase the strength, however, if the Ni content exceeds 5.0 weight %, the anti-seizure property will be adversely affected. Mn can also be added in a similar manner as Ni in a quantity not exceeding 5.0 weight %.

The size of the powders has a great influence on the porosity of the sintered layer. It is preferred that the powders are finer than 150 mesh. If the powder size is larger than 150 mesh, the porosity will correspondingly be increased to thereby lower the wear-resistant property of the sintered layer.

The acrylic resin binder of 3 to 15 vol.% and the alloy powders of the remaining part are mixed with each other. With the binder less than 3%, the bonding power will become insufficient and it will become difficult to maintain flexibility of the sheet. With the resin content exceeding 15 vol.%, there will be an adverse effect on the porosity of the sintered layer and the bonding power under a high temperature range.

Descriptions will now be made on the process for producing a powder alloy sheet in accordance with the present invention as well as the process for providing a wear-resistant layer on a workpiece.

(1) Providing a Powder Alloy Sheet

Acrylic resin is solved in a solvent such as acetone, toluene and MEK (methyl-ethyl-ketone) and mixed with powders of wear-resistant eutectic alloy so that the resin content becomes 3 to 15 vol.% and the alloy content becomes 97 to 85 vol.%. The mixture is then poured into a mold and maintained therein to have the solvent evaporated. The mixture is then passed through rolls to form a sheet having a desired thickness.

(2) Bonding the Sheet to a Workpiece

Figure 5:
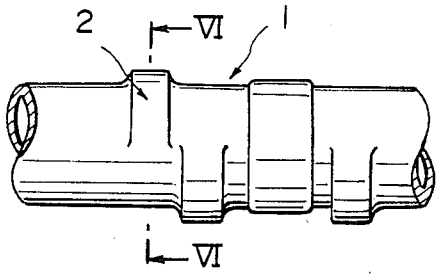
FIG. 5 is a fragmentary side view of an engine cam shaft to which the present invention can be applied.
Figure 6:
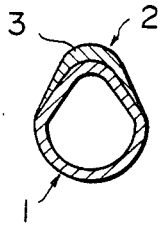
FIG. 6 is a sectional view taken substantially along the line VI—VI in FIG. 5.
Figure 7:
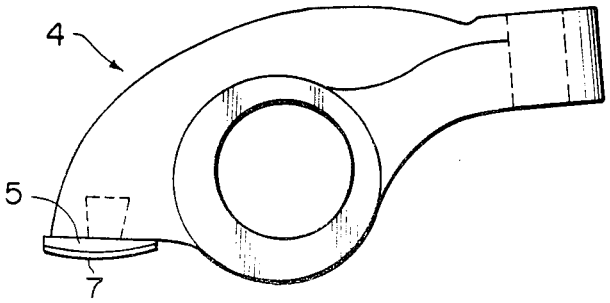
FIG. 7 is a side view of an engine rocker arm to which the present invention can be applied.
Figure 8:
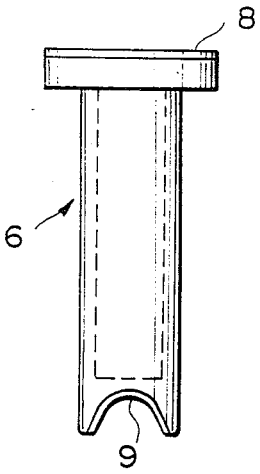
FIG. 8 is a side view of a tappet of an engine valve operating mechanism to which the present invention can also be applied.

Acrylic resin which is the same type as used in the alloy sheet is coated on one side of the sheet and bonded at the coated side to a surface of the workpiece where the wear-resistant property is required. The workpiece may for example a hollow cam shaft 1 for an internal combustion engine as shown in FIGS. 5 and 6. In that case, an alloy sheet 3 may be bonded to a cam lobe portion 2. The workpiece may also be a rocker arm 4 as shown in FIG. 7 which is made of an aluminum alloy and adapted to be used in an engine valve operating mechanism. The rocker arm 4 has a steel tip 5 for engagement with a valve actuating cam and the steel tip 5 may then be bonded with an alloy sheet 7. The workpiece may further be a tappet 6 as shown in FIG. 8 for use in an engine valve operating mechanism. The tappet 6 may then be bonded with alloy sheets 8 and 9 at the opposite end surfaces which are subject to sliding engagements with cooperating parts.

(3) Heating

The workpiece bonded with the powder alloy sheet is then heated in a non-oxidizing atmosphere such as a hydrogen atmosphere, nitrogen atmosphere or a vacuum. The heating rate has a great influence on the bonding between the sheet and the workpiece and on the porousity of the sintered layer. Where the heating rate is too slow, excessive amount of solid metal will be allowed to diffuse into the workpiece so that there will be a lack of liquid phase. Where the heating rate is too fast, however, excessive amount of gas is produced possibly causing a bubbling. Thus, a preferable heating rate is 10° to 40° C./min.

The invention will now be described by way of examples.

EXAMPLE 1

A ternary eutectic alloy containing 10.5 weight % of Mo, 2.5 weight % of Cr, 2.4 weight % of P, 3.6 weight % of C and the reminder substantially of Fe is prepared in a powder form finer than 150 mesh and mixed with acryl resin solved in acetone to form a mixture containing 93 vol.% of the alloy powder and 7 vol.% of the resin. The mixture is poured into a mold to form a sheet which is then bonded to a steel workpiece. The workpiece having the alloy sheet bonded thereto is heated to 1000° C. and maintained at the temperature for 20 minutes so that approximately 50 vol.% of liquid phase is produced. As the result, there is produced on the workpiece a wear-resistant sintered alloy layer containing 2.4 weight % of P, 3.6 weight % of C, 10.5 weight % of Mo, 2.5 weight % of Cr and the remainder substantially of Fe. The final product has a hardness of Hv. 696 and porosity less than 1.0%.

Figure 10:
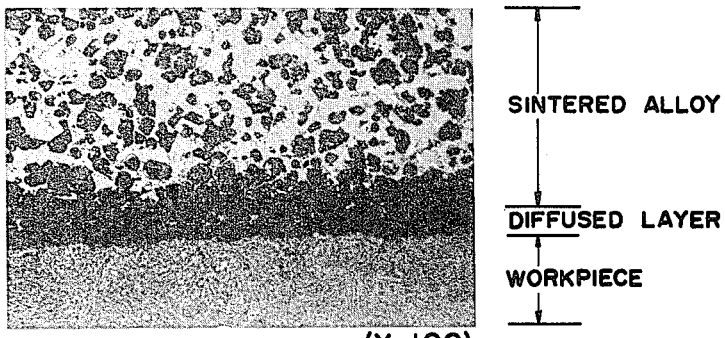
FIGS. 10 through 12 are microscopic photographs showing the sintered layers in the examples of the present invention.

In FIG. 10, there is shown a microscopic photograph with 100 times magnification of the interface between the workpiece and the sintered layer. In FIG. 10, the white-base, dark-spotted area shows the sintered layer, whereas the gray area is the workpiece with a black belt showing a diffused region.

EXAMPLE 2

Figure 11:
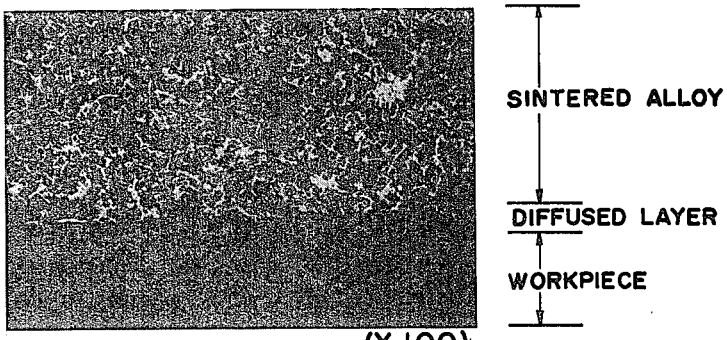

SUS 410 alloy according to Japanese Industrial Standard (JIS) is provided in powder form having a particle size finer than 150 mesh and mixed with the same volume of powders finer than 150 mesh of ternary eutectic alloy containing 10.5 weight % of Mo, 2.4 weight % of P, 3.6 weight % of C and the remainder substantially of Fe. The alloy mixture is then further mixed with acryl resin solved in acetone to form a slurry which is poured into a mold to form a sheet. The sheet is then bonded to a steel workpiece, and heated to 1090° C. and maintained at that temperature for 20 minutes so that 12 vol.% of liquid phase is produced. As the result, there is formed a wear-resistant sintered alloy layer comprised of 1.1 weight % of P, 1.8 weight % of C, 5.3 weight % of Mo, 7.5 weight % of Cr and the remainder substantially of Fe. The final product has a hardness of Hv. 626 and porosity less than 1.0%. In FIG. 11, there is shown a microscopic photograph of a section of the final product.

EXAMPLE 3

Figure 12:
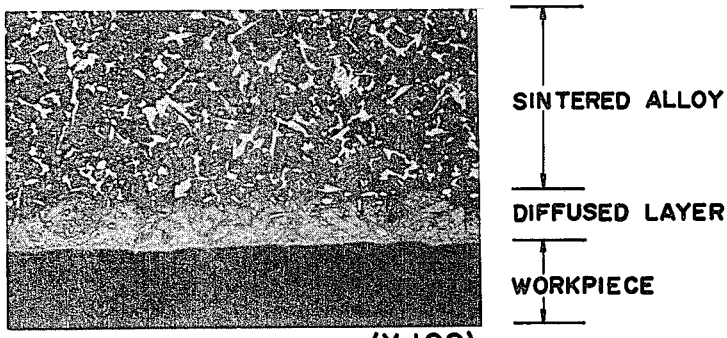

Powders finer than 150 mesh of SUS 410 alloy are mixed in an amount of 70 part in weight with 30 part in weight of powders finer than 150 mesh of ternary eutectic alloy containing 10.5 weight % of Mo, 2.4 weight % of P, 3.6 weight % of C and the remainder substantially of Fe, and with 1.4 part in weight of graphite powders. The mixture is then mixed with acryl resin solved in acetone to form a slurry containing 95 vol.% of alloy powders and 5 vol.% of resin. The slurry is then poured into a mold to form a sheet which is applied to a cam-engaging surface of a steel rocker arm and maintained at 1150° C. for 20 minutes to produce 11 vol.% of liquid phase. Thus, the rocker arm is formed at the cam-engaging surface with a wear-resistant sintered alloy layer containing 0.7 weight % of P, 2.5 weight % of C, 3.2 weight % of Mo. 9.4 weight % of Cr and the remainder substantially of Fe. The final product has a hardness of Hv. 707 and porosity less than 1.0%. FIG. 12 shows a microscopic photograph of a section of the final product.

Figure 13:
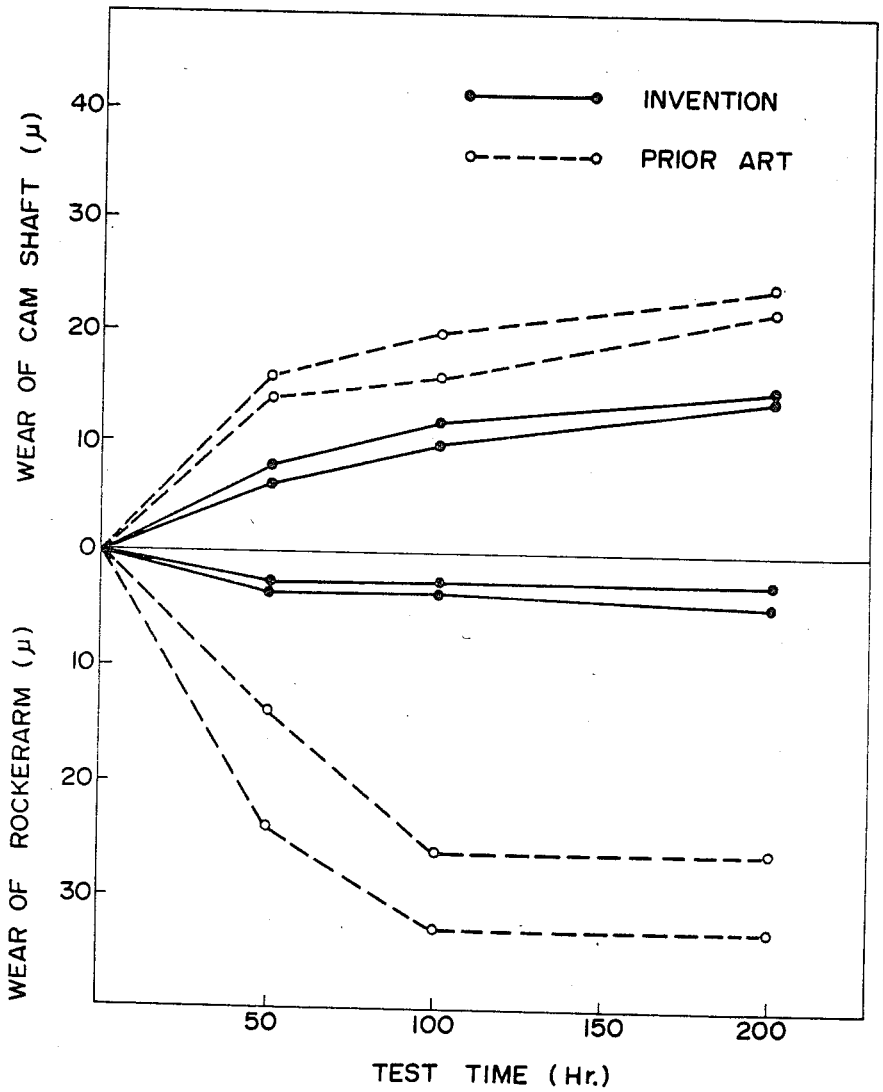
FIG. 13 is a diagram showing the results of wear tests.

The rocker arm thus prepared was subjected to a wear test by operating the rocker arm with a cast iron cam shaft having a chilled cam lobe. The cost iron is composed of 3.3 weight % of C, 1.8 weight % of Si, 0.7 weight % of Mn, 0.07 weight % of P, 0.05 weight % of S, 0.04 weight % of Cr and the remainder substantially of Fe. The test was performed with the engine speed of 2,000 rpm using deteriorated lubricant oil. The results are shown in FIG. 13. For the purpose of comparison, a similar test was also conducted with a rocker arm of chilled cast iron having the same composition as the cam shaft. The results of the test are also shown in FIG. 13. It will be noted that the products made in accordance with the present invention show significantly improved wear-resistant property.

Figure 9:
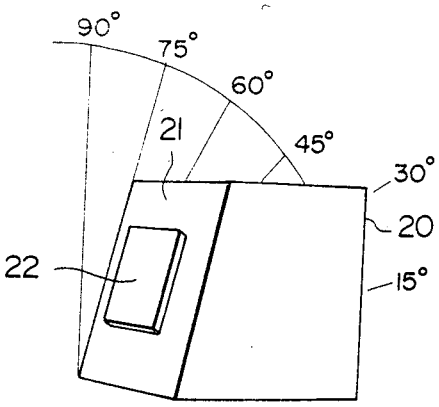
FIG. 9 is a perspective view showing a test piece for a peel-off test.

For peel-off tests, the powder alloy sheet of the example 2 is bonded to a workpiece of JIS-S45C. As shown in FIG. 9, the workpiece 20 has a sloped surface 21 on which the alloy sheet 22 is bonded. It has been proved that there is no peel-off of the alloy sheet when the temperature is increased to 1130° C.

The invention has thus been shown and described with reference to specific examples, however, it should be noted that the invention is in no way limited to the details of the described examples but changes and modifications may be made without departing from the scope of the appended claims.

What is claimed is:

1. A powder alloy sheet including powders of wear-resistant Fe—M—C type ternary eutectic alloy and acrylic resin binder, wherein M is at least one of Mo, P and B, said ternary alloy being contained in a quantity of 85 to 97% by volume and having 10 to 50 vol. % of liquid phase at a temperature of about 1000° to 1150° C., said acrylic resin binder being contained in a quantity of 15 to 3% by volume.

2. A powder alloy sheet in accordance with claim 1 which further has a coating of acrylic resin formed at one side of the sheet.

3. A powder alloy sheet in accordance with claim 1 in which the eutectic alloy is of a Fe—P—C type containing 0.5 to 2.5 weight % of P and 1.5 to 4.0 weight % of C.

4. A powder alloy sheet in accordance with claim 1 in which said entectic alloy is of Fe—Mo—C type containing 2.5 to 10.5 weight % of Mo.

5. A powder alloy sheet in accordance with claim 1 in which said eutectic alloy is of Fe—B—C type containing 0.5 to 3.0 weight % of B.

6. A powder allow sheet in accordance with claim 1 which further contains at least one of Cr, V and W in a quantity less than 10 weight %.

7. A powder alloy sheet in accordance with claim 1 which further contains Si in a quantity less than 5.0 weight %.

8. A powder alloy sheet in accordance with claim 1 which further contains Ni in a quantity less than 5.0 weight %.

9. A powder alloy sheet in accordance with claim 1 which further contains Mn in a quantity less than 5.0 weight %.

10. A powder alloy sheet in accordance with claim 1 wherein said powders of alloy are finer than 150 mesh.

11. A method for forming a wear-resistant layer on a workpiece comprising steps of providing a powder alloy sheet comprised of 85 to 97 vol. % of powders of wear-resistant Fe—M—C type ternary eutectic alloy wherein M is at least one of Mo, P and B and 15 to 3 vol. % of acrylic resin binder, said eutectic alloy having 10 to 50 vol. % of liquid phase at a temperature of about 1000° to 1150° C., coating acrylic resin on one side of the sheet, bonding the sheet on a workpiece surface, heating the workpiece under a non-oxidizing atmosphere at a heat-up rate wherein a sufficient liquid phase is produced but an excessive amount of gas is not produced to a semi-liquid phase sintering temperature to sinter the alloy powders.

12. A method in accordance with claim 11 in which the non-oxidizing atmosphere is one of hydrogen atmosphere, nitrogen atmosphere and vacuum.

13. A method in accordance with claim 11 in which said heating is conducted with a heat-up rate of 10° to 40° C./min.

14. A method in accordance with claim 11 in which said heating is performed so that the alloy has 10 to 50 vol.% of liquid phase.

* * * * *